United States Patent [19]

Skinner

[11] 4,448,165

[45] May 15, 1984

[54] FUEL INJECTION PUMPING APPARATUS

[75] Inventor: Robert T. J. Skinner, High Wycombe, England

[73] Assignee: Lucas Industries Limited, Birmingham, England

[21] Appl. No.: 298,802

[22] Filed: Sep. 2, 1981

[30] Foreign Application Priority Data

Oct. 29, 1980 [GB] United Kingdom ..... 8034741

[51] Int. Cl.[3] ..... F02D 17/00; F02D 1/06

[52] U.S. Cl. ..... 123/179 L; 123/450; 123/198 D; 417/462

[58] Field of Search ..... 123/179 L, 198 D, 198 DB, 123/450, 462; 417/462, 295, 221

[56] References Cited

U.S. PATENT DOCUMENTS

| | | | |
|---|---|---|---|
| 3,485,225 | 12/1969 | Bailey | 123/450 |
| 4,067,348 | 1/1978 | Davis | 123/198 DB |
| 4,080,946 | 3/1978 | Cunningham | 123/198 D |
| 4,146,003 | 3/1979 | Drori | 123/462 |
| 4,176,640 | 12/1979 | Skinner | 123/450 |
| 4,187,822 | 2/1980 | Craven | 123/450 |

*Primary Examiner*—Charles J. Myhre
*Assistant Examiner*—Carl Stuart Miller

[57] ABSTRACT

A fuel injection pumping apparatus for supplying fuel to an internal combustion engine comprises an injection pump to which fuel is supplied by a low pressure pump. A part of the injection pump defines a surface against which a control pressure can act to vary the amount of fuel supplied by the injection pump, the part being spring loaded by a spring in a direction to oppose the force exerted by the control pressure and to increase the amount of fuel supplied. The control pressure is derived from the low pressure pump by means of a control system and if the output pressure of the low pressure pump should fall due to for example fuel starvation, the part will move in the direction to increase the amount of fuel supplied by the apparatus, this being permitted even though the output pressure is reduced. In order to avoid an increase in the amount of fuel supplied a pressure responsive valve is provided which is responsive to the output pressure of the low pressure pump and which closes to prevent fuel flow to the injection pump when the pressure falls below a predetermined value.

5 Claims, 2 Drawing Figures

FUEL INJECTION PUMPING APPARATUS

This invention relates to a liquid fuel injection pumping apparatus for supplying fuel to an internal combustion engine and of the kind comprising an injection pump operable in use to deliver fuel in timed relationship with an associated engine, a low pressure supply pump for supplying fuel to the injection pump, valve means for controlling the output pressure of the supply pump so that it varies in accordance with the speed at which the apparatus is driven, and a resiliently loaded component defining a surface upon which the output pressure of the supply pump acts to vary the amount of fuel supplied at each injection stroke of the injection pump.

With such an apparatus a danger exists if for example, the output pressure of the supply pump should fall. In such a situation the component can move under the action of its resilient loading to effect an increase in the supply of fuel to the injection pump with the result that more fuel would be supplied by the injection pump to the associated engine even though the pressure available to fill the injection pump is reduced. This can result in an increase in the speed of the associated engine beyond its safe maximum value.

The object of the present invention is to provide an apparatus of the kind specified in a simple and convenient form.

According to the invention an apparatus of the kind specified includes a pressure responsive valve located between the low pressure supply pump and the injection pump, said valve being arranged to close when the output pressure of the low pressure supply pump is below a predetermined value and a restricted flow path through which fuel can be supplied to the injection pump for the purpose of starting the engine.

Figure 1:
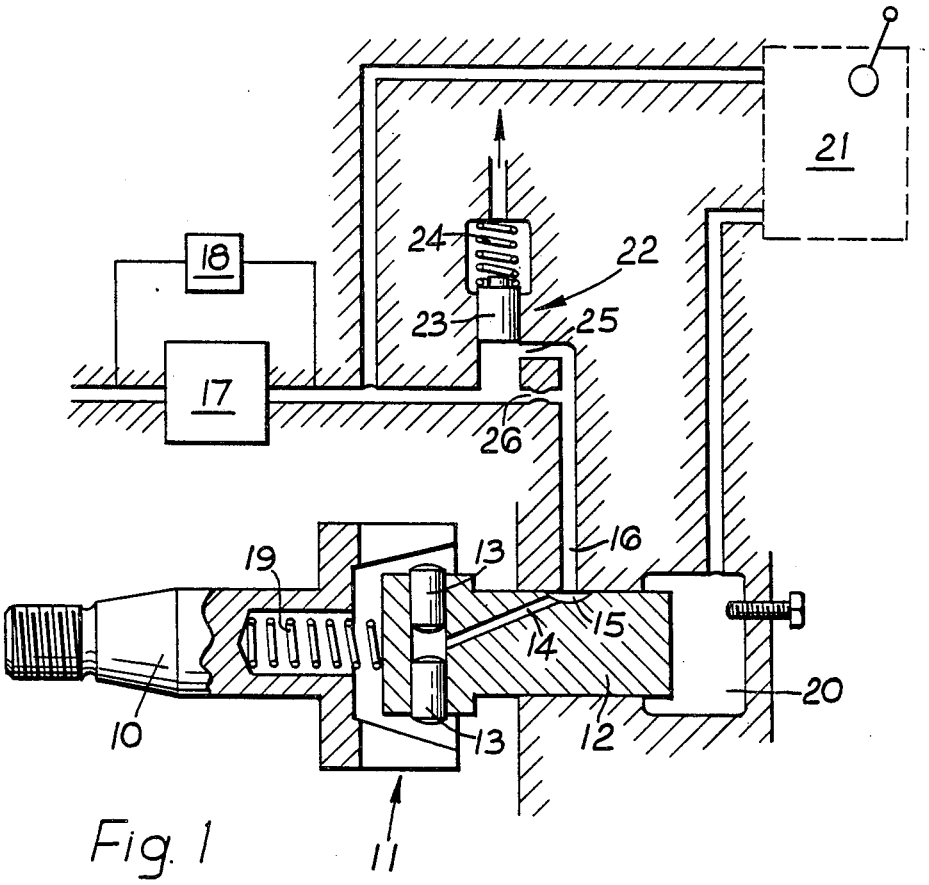
Figure 2:
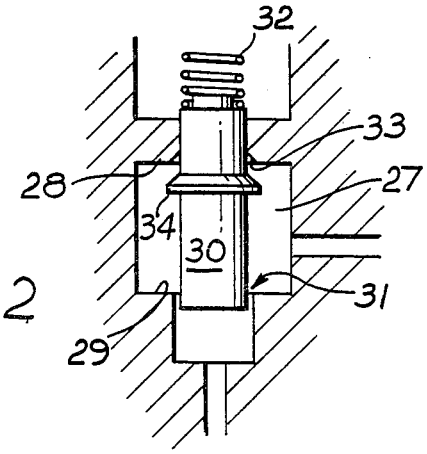

An example of and a modification of an apparatus in accordance with the invention will now be described with reference to FIGS. 1 and 2 of the accompanying diagrammatic drawings, in which:

FIG. 1 shows a diagram of the apparatus according to one embodiment of the invention, and FIG. 2 shows a modification of the pressure responsive valve between the low pressure supply pump and the injection pump according to the apparatus of FIG. 1.

The mechanical construction of the apparatus is as described in British patent specification Ser. No. 2037365. The apparatus comprises a drive shaft 10 having an enlarged portion 11 of generally annular form. The drive shaft 10 is driven in use in timed relationship with the associated engine and it is coupled to a distributor member 12 rotatable in a surrounding body. The distributor member mounts a pair of plungers 13 which are movable inwardly by means of cam lobes formed on a cam ring not shown. During inward movement of the plungers fuel is displaced to an outlet. Communicating with the bore containing the plungers is a passage 14 which terminates in a slot 15 formed on the periphery of the distributor member 12. For registration with the slot there is provided a plurality of inlet ports 16 only one of which is shown. The inlet ports 16 communicate with the outlet of a low pressure supply pump 17 with which is associated a valve 18 which controls the output pressure so that it varies in accordance with the speed at which the drive shaft is rotated. Conveniently, the rotary part of the low pressure pump is driven by the input shaft 10.

The distributor memeber 12 is baised relative to the drive shaft by means of a spring 19 and the extent of outward movement of the plungers is determined by the axial position of the distributor member. For this purpose the internal surface of the enlarged portion of the drive shaft is tapered and followers associated with the plungers 13 respectively but not shown in the drawing, have complementary surfaces for engagement with the tapered internal surface. As the distributor member moves under the action of the spring 19, the permitted outward movement of the plungers while fuel is being supplied to the bore containing the plungers, is increased. Hence more fuel will be supplied to the engine.

The end of the distributor member constitutes a surface exposed to the pressure within a chamber 20 and as the pressure in the chamber 20 is increased, the distributor member is moved against the action of the spring 19.

The pressure within the chamber 20 is determined by a control system indicated at 21 and the source of pressure is the outlet pressure of the supply pump 17. The control system may be electronic in nature.

In the event that the outlet pressure of the pump 17 falls for example, due to fuel starvation, then whilst initially the control system will effect correction so that the axially setting of the distributor member is not altered, a value of pressure will be reached at which the control system can no longer control the pressure in the chamber 20. The distributor member 12 will therefore move under the action of the spring 19 to the maximum fuel position. Even through the output pressure of the pump 17 has fallen to a low value, sufficient pressure is available to move the plungers outwardly their maximum extent and as a result there will be an increase in the flow of fuel to the engine. As a result the engine speed could exceed its maximum safe value.

In order to effect a control over the engine speed, a pressure responsive valve 22 is provided and this comprises a valve member 23 which is exposed at one end to the output pressure of the pump 17. The valve member is biased by a spring 24 and it controls the flow of fuel through a port 25. When the output pressure of the pump is at its normal value, the port 25 is fully uncovered but when the pressure falls below a predetermined safe value, the valve member 23 moves to cover the port 25 thereby to prevent flow of fuel through the port 25 and the inlet port 16.

In order to enable the associated engine to be started, a restricted flow path in the form of an orifice 26 is provided, this being connected in parallel with the pressure responsive valve. The arrangement is such that when starting the engine when the output pressure of the pump 17 is low, sufficient fuel can flow through the orifice 26 to enable the plungers to move outwardly their maximum extent it being appreciated that when starting the engine the time available for filling the bore containing the plungers is extended. The size of the orifice 26 is chosen so that the flow of fuel through the orifice when the port 25 is closed is insufficient to allow the engine even when no load is applied, to exceed its safe maximum speed.

In the modification shown in FIG. 2 the valve comprises a chamber 27 having end walls 28, 29. The valve member 30 is of cylindrical form and is slidable in an aperture in the end wall 28. The opposite end wall defines an aperture 31 slightly larger than the valve member so that a clearance is established and the aperture communicates with the outlet of the pump 17 so that the end of the valve member is subject to the outlet pressure of the pump 17. The other end of the valve member is engaged by a spring 32 which is housed in a low pressure region.

The chamber 27 is in communication with the injection pump and as shown the valve member is in the closed positon as for example when the associated engine is at rest. For engine starting purposes sufficient flow of fuel can take place along the restricted flow path formed by the aforesaid clearance. When the engine starts, and the output pressure of the pump increases the valve member is moved out of the aperture 31 to allow full flow of fuel to the injection pump.

Since the spring is located in a low pressure region there will be a small flow of fuel along the working clearance defined between the valve member and the wall of the aperture in the end wall 28. The fuel may contain small particles of dirt which could flow into this clearance and cause the valve member to stick. In order to minimize this risk there is defined about the aperture a seating 33 with which co-operates in the open position of the valve member, a complementary surface on a flange 34 defined on the valve member. Thus the flow of fuel is prevented when the valve member is in the open position and with no flow of fuel the risk of the valve member sticking is minimized.

I claim:

1. A liquid fuel injection pumping apparatus for supplying fuel to an internal combustion engine, comprising an injection pump operable in use to deliver fuel in timed relationship with an associated engine, a low pressure supply pump for supplying fuel to the injection pump, valve means for controlling the output pressure of the supply pump so that it varies in accordance with the speed at which the apparatus is driven, a resiliently loaded component defining a surface upon which the output pressure of the supply pump acts to vary the amount of fuel supplied at each injection stroke of the injection pump, a pressure responsive valve responsive to the output pressure of the low pressure supply pump located between the low pressure supply pump and the injection pump, said valve being arranged to close when the output pressure of the low pressure supply pump is below a predetermined value, and a restricted flow path through which fuel can be supplied to the injection pump for the purpose of starting the engine.

2. An apparatus according to claim 1 in which said pressure responsive valve comprises a valve member, one end of said valve member being exposed to the output pressure of the low pressure supply pump, resilient means opposing movement of said valve member by said pressure and a port connected with said injection pump and arranged to be covered by said valve member when the pressure is below said predetermined value.

3. An apparatus according to claim 2 in which said restricted flow path comprises an orifice connected in parallel with said valve.

4. An apparatus according to claim 1 in which said valve comprises a valve body defining a chamber connected to said injection pump, a cylindrical valve member guided for movement in one end wall of the chamber and having a working clearance therewith, said valve member extending with clearance through an aperture in the other end wall of the chamber, a passage connected to the outlet of the low pressure supply pump whereby the end of the valve member extending through said aperture is exposed to the outlet pressure of the low pressure supply pump and resilient means acting upon the other end of the valve member, said clearance defining in the closed position of the valve member, said restricted flow path.

5. A liquid fuel injection pumping apparatus for supplying fuel to an internal combustion engine, comprising an injection pump operable in use to deliver fuel in timed relationship with an associated engine, a low pressure supply pump for supplying fuel to the injection pump, valve means for controlling the output pressure of the supply pump so that it varies in accordance with the speed at which the apparatus is driven, a resiliently loaded component defining a surface upon which the output pressure of the supply pump acts to vary the amount of fuel supplied at each injection stroke of the injection pump, and a pressure responsive valve responsive to the output pressure of the low pressure supply pump located between the low pressure supply pump and the injection pump, said valve comprising a valve body defining a chamber connected to said injection pump, a cylindrical valve member guided for movement in one end wall of the chamber and having a working clearance therewith, said valve member extending with clearance through an aperture in the other end wall of the chamber, a passage connected to the outlet of the low pressure supply pump so that the end of the valve member extending through said aperture is exposed to the outlet pressure of the low pressure supply pump, and resilient means acting upon the other end of the valve member, whereby said valve is arranged to close when the output pressure of the low pressure supply pump is below a predetermined value, and said clearance defines in the closed position of the valve member a restricted flow path through which fuel can be supplied to the injection pump for the purpose of starting the engine, and said valve further has a seating defined on said one end wall of the chamber, and a flange on said valve member, said flange in the open position of said valve member cooperating with said seating to prevent flow of fuel along the working clearance defined below the valve member and the one end wall of the chamber.

* * * * *